US009016381B2

(12) United States Patent
Dietz et al.

(10) Patent No.: US 9,016,381 B2
(45) Date of Patent: Apr. 28, 2015

(54) MUDLINE MANAGED PRESSURE DRILLING AND ENHANCED INFLUX DETECTION

(75) Inventors: David Albert Dietz, Houston, TX (US); Robert Arnold Judge, Houston, TX (US); Ahmet Duman, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 249 days.

(21) Appl. No.: 13/050,164

(22) Filed: Mar. 17, 2011

(65) Prior Publication Data

US 2012/0234550 A1 Sep. 20, 2012

(51) Int. Cl.

| | |
|---|---|
| ***E21B 34/04*** | (2006.01) |
| ***B23P 11/00*** | (2006.01) |
| ***E21B 21/08*** | (2006.01) |
| ***E21B 21/10*** | (2006.01) |

(52) U.S. Cl.

CPC ..... *E21B 21/08* (2013.01); *E21B 21/10* (2013.01)

(58) Field of Classification Search

CPC ..... E21B 21/08; E21B 21/10
USPC ..... 166/344, 345, 358, 359, 363, 367, 368, 166/85.4; 175/5, 8; 251/1.1–1.3
See application file for complete search history.

(56) References Cited

U.S. PATENT DOCUMENTS

| | | | | |
|---|---|---|---|---|
| 3,250,336 | A * | 5/1966 | Haeber et al. | 175/7 |
| 3,815,673 | A * | 6/1974 | Bruce et al. | 166/359 |
| 6,062,313 | A * | 5/2000 | Moore | 166/357 |
| 6,102,673 | A | 8/2000 | Mott et al. | |
| 6,374,925 | B1 * | 4/2002 | Elkins et al. | 175/25 |
| 6,415,877 | B1 * | 7/2002 | Fincher et al. | 175/5 |
| 6,457,529 | B2 * | 10/2002 | Calder et al. | 166/368 |
| 6,904,982 | B2 | 6/2005 | Judge et al. | |
| 7,270,185 | B2 | 9/2007 | Fontana et al. | |
| 7,562,723 | B2 | 7/2009 | Reitsma | |
| 7,650,950 | B2 | 1/2010 | Leuchtenberg | |
| 7,721,822 | B2 | 5/2010 | Krueger et al. | |
| 7,832,706 | B2 * | 11/2010 | Judge | 251/1.3 |
| 2003/0066650 | A1 * | 4/2003 | Fontana et al. | 166/358 |
| 2003/0168258 | A1 * | 9/2003 | Koederitz | 175/38 |
| 2004/0238177 | A1 * | 12/2004 | Fossli | 166/364 |
| 2008/0060846 | A1 | 3/2008 | Belcher et al. | |
| 2009/0095464 | A1 * | 4/2009 | McGrath et al. | 166/53 |
| 2010/0243260 | A1 * | 9/2010 | Donohue et al. | 166/344 |
| 2012/0037361 | A1 * | 2/2012 | Santos et al. | 166/250.08 |

FOREIGN PATENT DOCUMENTS

WO 2010071656 A1 6/2010

OTHER PUBLICATIONS

Search Report and Written Opinion dated Aug. 5, 2013 from corresponding EP Application No. 12158925.3.

* cited by examiner

*Primary Examiner* — James G Sayre
(74) *Attorney, Agent, or Firm* — Bracewell & Giuliani LLP

(57) ABSTRACT

Apparatuses useable in drilling installations for adjusting a mud return flow in a mud loop, at a location far from a mud tank are provided. An apparatus includes (1) a sensor located close to a seabed and configured to acquire values of at least one parameter related to a return mud flow, (2) a valve located near the sensor and configured to regulate the return mud flow, and (3) a controller connected to the valve and the sensor. The controller is configured to automatically control the valve to regulate the return mud flow towards achieving a value of a control parameter close to a predetermined value, based on the values acquired by the sensor. Methods of incorporating an apparatus in a drilling installation and retrofitting existing installations are also provided.

10 Claims, 5 Drawing Sheets

Figure 1
(Background Art)
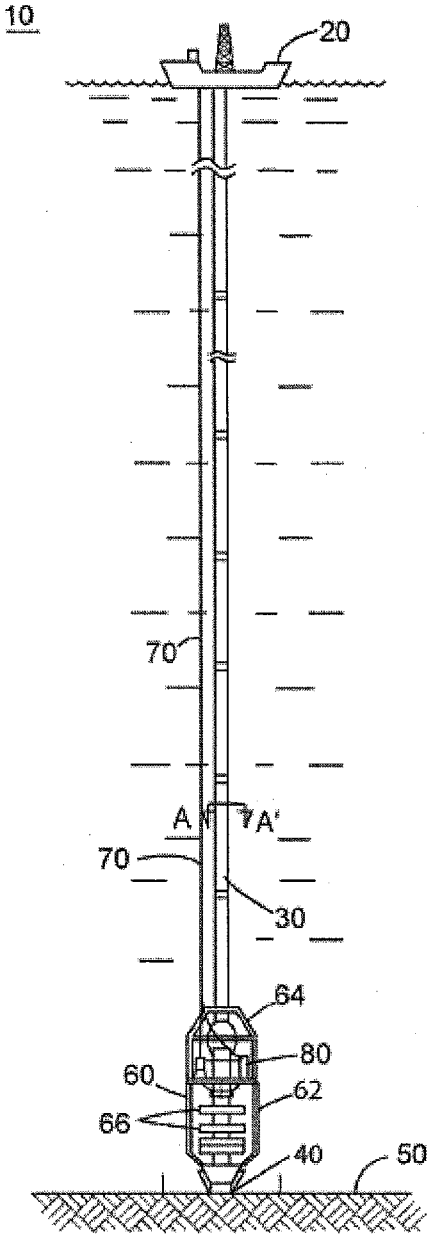
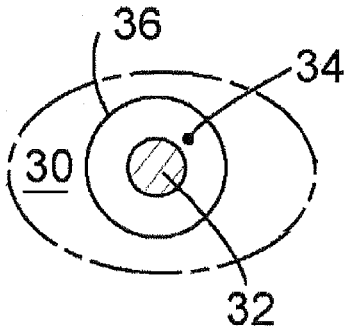
Figure 1A
(Background Art)

MUDLINE MANAGED PRESSURE DRILLING AND ENHANCED INFLUX DETECTION

BACKGROUND

1. Technical Field

Embodiments of the subject matter disclosed herein generally relate to methods and apparatuses useable in drilling installations for adjusting a mud return flow in a mud loop, far from a mud tank.

2. Discussion of the Background

During the past years, with the increase in price of fossil fuels, the interest in developing new production fields has dramatically increased. However, the availability of land-based production fields is limited. Thus, the industry has now extended drilling to offshore locations, which appear to hold a vast amount of fossil fuel.

A traditional offshore oil and gas installation 10, as illustrated in FIG. 1, includes a platform 20 (of any other type of vessel at the water surface) connected via a riser 30 to a wellhead 40 on the seabed 50. It is noted that the elements shown in FIG. 1 are not drawn to scale and no dimensions should be inferred from relative sizes and distances illustrated in FIG. 1.

Inside the riser 30, as shown in the cross-section view of FIG. 1A, there is a drill string 32 at the end of which a drill bit (not shown) is rotated to extend the subsea well through layers below the seabed 50. Mud is circulated from a mud tank (not shown) on the drilling platform 20 through the drill string 32 to the drill bit, and returned to the drilling platform 20 through an annular space 34 between the drill string 32 and a casing 36 of the riser 30. The mud maintains a hydrostatic pressure to counter-balancing the pressure of fluids coming out of the well and cools the drill bit while also carrying crushed or cut rock at the surface. At the surface, the mud returning from the well is filtered to remove the rock, and re-circulated.

During drilling, gas, oil or other well fluids at a high pressure may burst from the drilled formations into the riser 30. Such an event (which is sometimes referred to as a "kick" or a "blowout") may occur at unpredictable moments. If the burst is not promptly controlled, the well and the equipment of the installation may be damaged. In order to protect the well and/or the equipment that may be damaged, a blowout preventer (BOP) stack 60 is located close to the seabed 50. The BOP stack may include a lower BOP stack 62 attached to the wellhead 40, and a Lower Marine Riser Package ("LMRP") 64, which is attached to a distal end of the riser 30. During drilling, the lower BOP stack 62 and the LMRP 64 are connected.

A plurality of blowout preventers (BOPs) 66 located in the lower BOP stack 62 or in the LMRP 64 are in an open state during normal operation, but may be closed (i.e., switched in a close state) to interrupt a fluid flow through the riser 30 when a "kick" occurs. Electrical cables and/or hydraulic lines 70 transport control signals from the drilling platform 20 to a controller 80, which is located on the BOP stack 60. The controller 80 controls the BOPs 66 to be in the open state or in the close state, according to signals received from the platform 20 via the electrical cables and/or hydraulic lines 70. The controller 80 also acquires and sends to the platform 20, information related to the current state (open or closed) of the BOPs. The term "controller" used here covers the well known configuration with two redundant pods.

Traditionally, as described, for example, in U.S. Pat. Nos. 7,395,878, 7,562,723, and 7,650,950 (the entire contents of which are incorporated by reference herein), a mud flow output from the well is measured at the surface of the water.

The mud flow input into the well may be adjusted to maintain a pressure at the bottom of the well within a targeted range or around a desired value, or to compensate for kicks and fluid losses.

Operators of oil and gas installations try to maintain an equivalent circulating density (ECD) at the bottom of a well close to a set value. The ECD is a parameter incorporating both the static pressure and the dynamic pressure. The static pressure depends on the weight of the fluid column above the measurement point, and, thus, of the density of the mud therein. The density of the mud input into the well via the drill string 32 may be altered by crushed rock or by fluid and gas emerging from the well. The dynamic pressure depends on the flow of fluid. Control of the mud flow may compensate for the variation of mud density due to these causes. U.S. Pat. No. 7,270,185 (the entire content of which is incorporated by reference herein) discloses methods and apparatuses operating on the return mud path, below the water surface, to partially divert or discharge the mud returning to the surface when the ECD departs from a set value.

The volume and complexity of conventional equipment employed in the mud flow control are a challenge in particular due to the reduce space on a platform of an offshore oil and gas installation.

Another problem with the existing methods and devices is the relative long time (e.g., tens of minutes) between a moment when a disturbance of the mud flow occurs at the bottom of the well and when a change of the mud flow is measured at the surface. Even if information indicating a potential disturbance of the mud flow is received from the controller 80 faster, a relative long time passes between when an input mud flow is changed and when this change has a counter-balancing impact at the bottom of the well.

Accordingly, it would be desirable to provide methods and devices useable in offshore drilling installations for regulating the mud return flow close to the seabed, thereby overcoming the afore-described problems and drawbacks.

SUMMARY

According to one exemplary embodiment, an apparatus useable in an offshore drilling installation having a mud loop into a well drilled below the seabed is provided. The apparatus includes: (1) a sensor configured to be located close to a seabed and to acquire values of at least one parameter related to a return mud flow, (2) a valve located near the sensor and configured to regulate the return mud flow, and (3) a controller connected to the valve and the sensor. The controller is configured to automatically control the valve to regulate the return mud flow towards achieving a value of a control parameter close to a predetermined value, based on the values acquired by the sensor.

According to another embodiment, a method of manufacturing an offshore drilling installation configured to regulate a return mud flow close to the seabed is provided. The method includes placing a sensor inside an annular space through which a return mud flow passes, close to the seabed, the sensor being configured to acquire values of at least one parameter related to the return mud flow. The method further includes placing a valve near the sensor, the valve being configured to regulate the return mud flow. The method also includes connecting a controller to the valve and the sensor, the controller being configured to automatically control the valve to regulate the return mud flow towards achieving a value of a control parameter close to a predetermined value, based on the values received from the sensor.

According to another embodiment, a method of retrofitting an offshore drilling installation having a mud loop into a well and a plurality of blowout preventers (BOPs) located close to a seabed is provided. The method includes placing a sensor below the BOPs, the sensor being configured to acquire values of at least one parameter related to a return mud flow. The method further includes retrofitting one of the BOPs to operate as a valve configured to regulate the return mud flow. The method also includes connecting a controller located near the BOPs to the retrofitted BOP and the sensor, the controller being configured to automatically control the retrofitted BOP based on the values received from the sensor, to regulate the mud flow towards achieving a value of a control parameter close to a predetermined value.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 1 is a schematic diagram of a conventional offshore rig;

FIG. 1A is a sectional view of the rig of FIG. 1 and taken along lines A-A'.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a drilling installation having a mud loop to maintain desired drilling parameters. However, the embodiments to be discussed next are not limited to these systems, but may be applied to other systems that require local control of a fluid flow at a location far from the fluid source.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
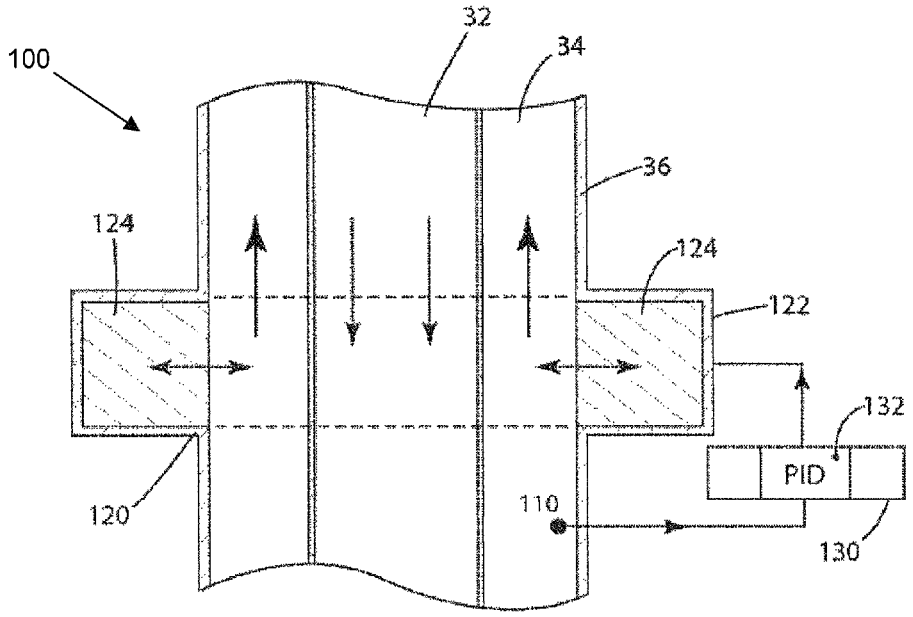
FIG. 2 is a schematic diagram of an apparatus, according to an exemplary embodiment.

FIG. 2 is a schematic diagram of an exemplary embodiment of an apparatus 100 useable in an offshore drilling installation having a mud loop. The apparatus 100 is configured to automatically regulate a returning mud flow towards achieving a value of a control parameter close to a predetermined value. Mud pumped into the well, for example, from a platform on the water surface, is circulated through a drill string 32 to a drill bit (not shown), and returned to the top through an annular space 34 between the drill string 32 and a casing 36.

A sensor 110 is located in the annular space 34 (between the drill string 32 and a casing 36) close to the seabed. The sensor 110 is configured to acquire information related to a mud flow returning from the bottom of the well. A distance from a source of the mud (i.e., a mud tank of a platform at the water surface) to the seabed may be thousands of feet. Therefore it may take a significant time interval (minutes or even tens of minutes) until a change of a parameter (e.g., pressure or flow rate) related to the mud flow becomes measurable at the surface.

A valve 120 is located in the proximity of the sensor 110. The valve is configured to regulate the returning mud flow, by modifying (increasing or decreasing) a surface of the annular space 34. The valve 120 is controlled by a controller 130 connected to the sensor 110. The controller 130 is configured to automatically control the valve 120 based on the values received the sensor 110, in order to regulate the returning mud flow towards achieving a value of a control parameter close to a predetermined value. Automatically controlling means that no signal from the surface is expected or required. However, this mode of operating does not exclude a connection between the control loop and an external operator that may enable occasional manual operation or receiving new parameters, such as, the predetermined value.

In one embodiment, the sensor 110 may include a pressure sensor and the control parameter may be the measured pressure or another parameter that may be calculated based on the measured pressure. The controller 130 controls the valve 120 to close (decreasing the flow and, thus, the dynamic pressure) if the pressure is larger than a set value, or to open (increasing the flow and, thus, the dynamic pressure) if the pressure is smaller than the set value. The controlled pressure may be the pressure below the valve or at a bottom of the well. Alternatively, the control parameter may be the equivalent circulating density which is the density of a column of fluid producing a pressure equal to the sum of the static and the dynamic pressure at the place of the measurement.

In another embodiment, the sensor 110 may also include a flow meter measuring the mud flow therethrough, and the control parameter may be the mud flow itself. The controller 130 then controls the valve 120 to close if the mud flow is larger than a set value, or to open if the mud flow is smaller than the set value. Yet in another embodiment the controller 130 may receive information about both the amount of returning mud flow from a mud flow meter and pressure from a pressure sensor.

The valve 120 may include a cavity 122 extending outside a column defined by the cavity 36, and hosting ram blocks 124 that can move inside the annular space 34 towards the drill string 32 thereby regulating the mud flow. The blocks 124 may be made of an erosion-resistant material.

The controller 130 may include a proportional-integral-derivative (PID) loop 132. Such a control loop provides the advantage of taking into consideration for determining a corrective action (e.g., degree of opening of the valve 120) not only a current value of a variable (e.g., the measured parameter or the evaluated control parameter), but also its history by integration and tendency by derivative. The three terms—current value, integration result and derivative result—are considered with different weights for determining a corrective action necessary to bring a control value closer to a (desired) set value. Alternatively, the controller 130 may be a processor, dedicated circuitry, etc.

Figure 3:
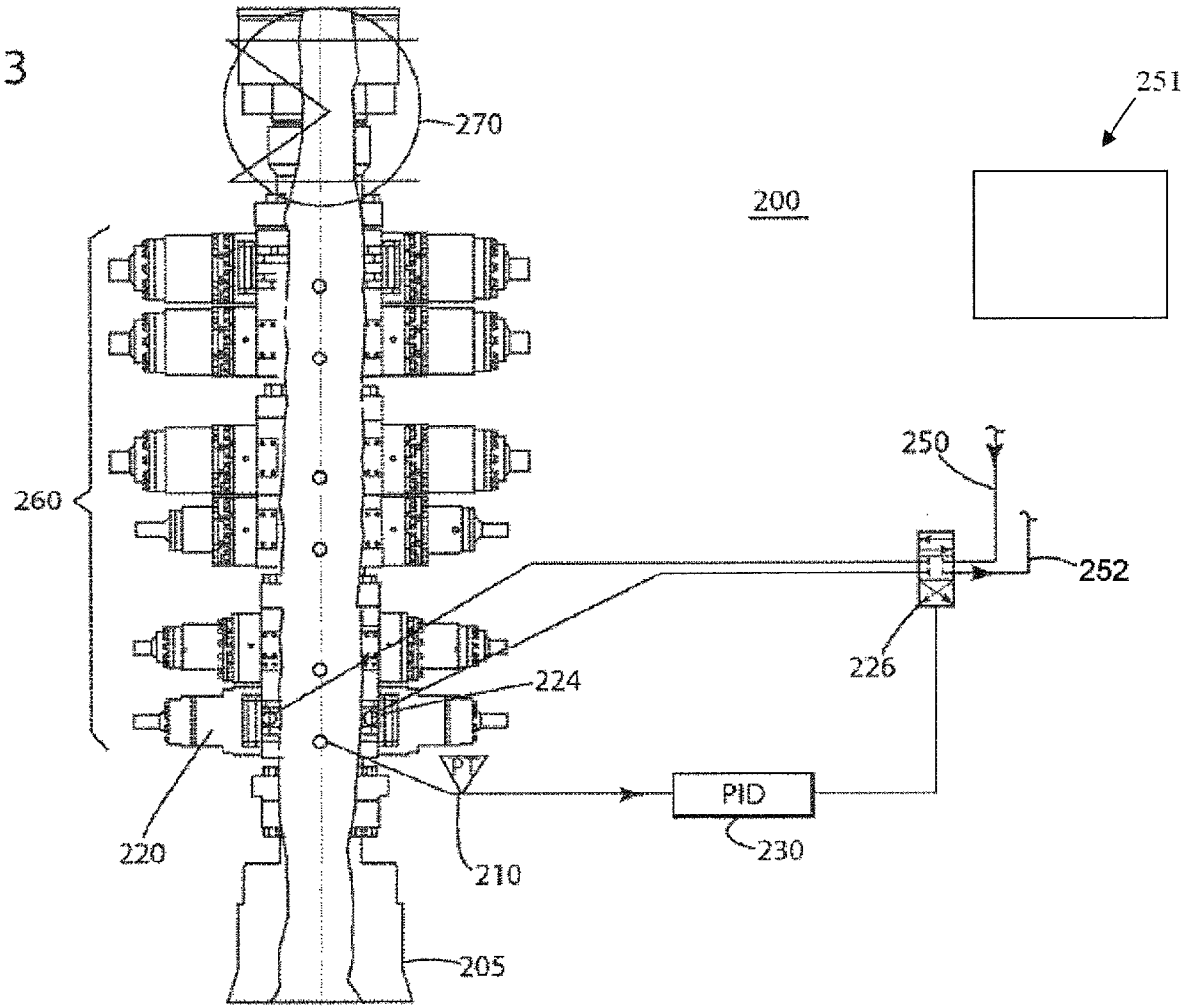
FIG. 3 is a schematic diagram of an apparatus, according to another exemplary embodiment.

As illustrated in FIG. 3, according to another embodiment, in an a drilling installation 200 having a mud loop, a blowout preventer (BOP) 220 of a BOP stack 260 (located close to a wellhead 205 on the seabed) may be retrofitted to function similar to the valve 120. A low range pressure transducer 210 is installed below the BOP 220. The transducer 210 may, for example, measure pressures in the range of 0-300 psi. The ram blocks 224 of the BOP 220 may be controlled hydraulically via a proportional valve 226 connected to a PID loop output 230. The proportional valve 226 receives hydraulic fluid via a supply line 250 coming from a POD of the installation 200, a subsea accumulator or another source, such as, a remote operated vehicle (ROV) 251. The proportional valve 226 is connected to a hydraulic return line 252 in order to return the hydraulic fluid back to a pod or the subsea accumulator or may vent it, respectively. The proportional valve 226 may be controlled via commands conveyed by the ROV.

A mass flow meter 270 may be installed, for example, above the BOP stack 260 to enhance the influx detection and thus control of the pressure profile.

In an alternative embodiment, an annular blowout preventer may be configured to operate as the valve 120. In this case, the size of an orifice of the annular blowout preventer is controlled to regulate the return mud flow.

Although the above-described embodiments have been described for an offshore drilling installation (either new or retrofitted), similar embodiments may be integrated in land-based drilling installations.

Due to the proximity of the sensor, valve and controller, the control is performed promptly (e.g., less than a tenth of a second between detection and corrective action, as opposed to minutes in the conventional approach) and can be performed frequently (e.g., few times every second).

At least some of the embodiments result in an increase of safety. A response time for return flow variation is significantly reduced without requiring expensive equipments. Wells that currently are not considered useable due to the frequent fluid influxes may be drilled using a prompt control according to some embodiments. Moreover, some embodiments provide an early and accurate influx (i.e., from the well) detection and an early kill or shut-in of the influx. These enhancements result in better control of the pressure of the bottom of the well and maintaining the equivalent circulating pressure within a narrower range. Using some embodiments, an equivalent weight of the mud may be changed without circulating out the mud already pumped in the well. Due to the better control of the pressure at the bottom of the well the formation damage is reduced and fewer situations of stuck drill pipe occur.

Figure 4:
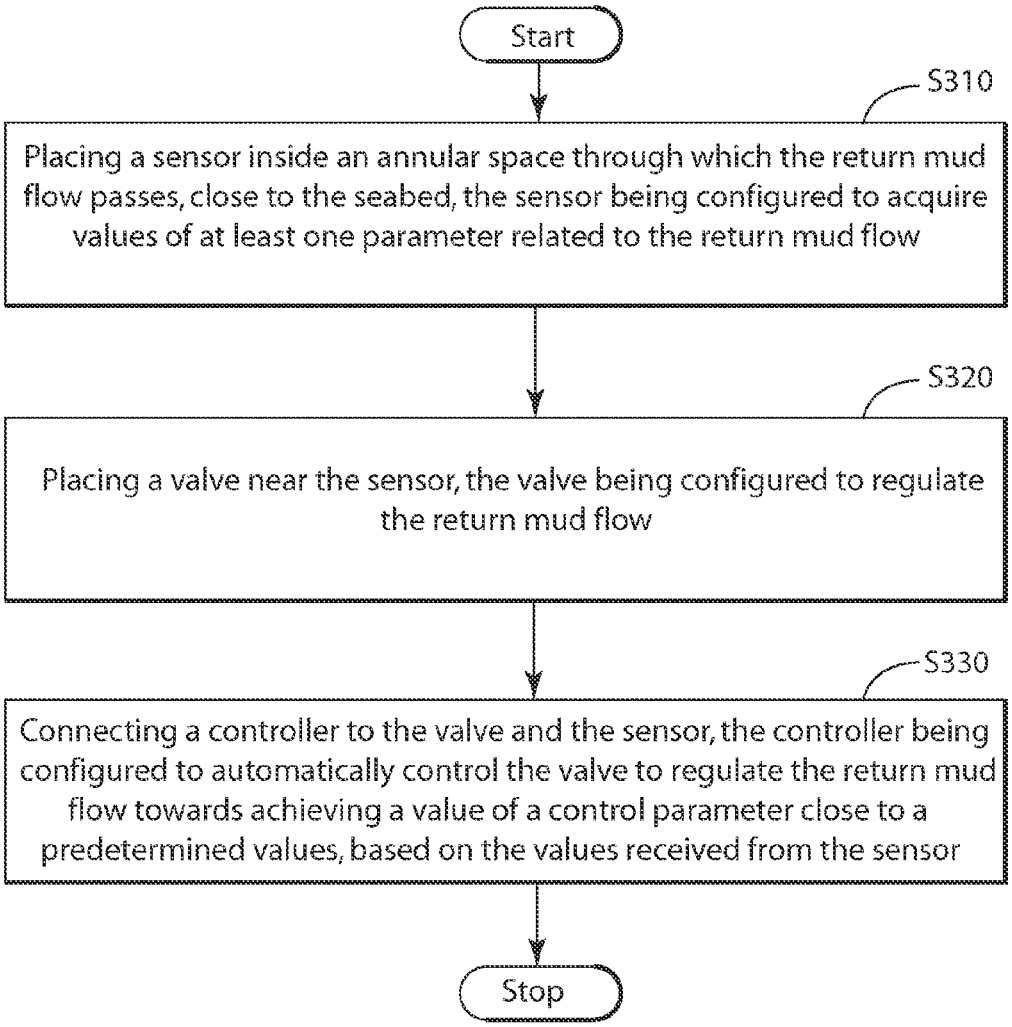
FIG. 4 is a flow diagram of a method of manufacturing an offshore drilling installation configured to control a return mud flux close to the seabed according to an exemplary embodiment.

A flow diagram of a method 300 of manufacturing an offshore drilling installation configured to control a return mud flux close to the seabed is illustrated in FIG. 4. The method 300 includes placing a sensor inside an annular space through which the return mud flow passes, close to the seabed, the sensor being configured to acquire values of a parameter related to the return mud flow, at S310. Further, the method 300 includes placing a valve near the sensor, the valve being configured to regulate the return mud flow, at S320. The method 300 also includes connecting a controller to the valve and the sensor, the controller being configured to automatically control the valve to regulate the return mud flow towards achieving a value of a control parameter close to a predetermined value, based on the values received from the sensor, at S330.

Figure 5:
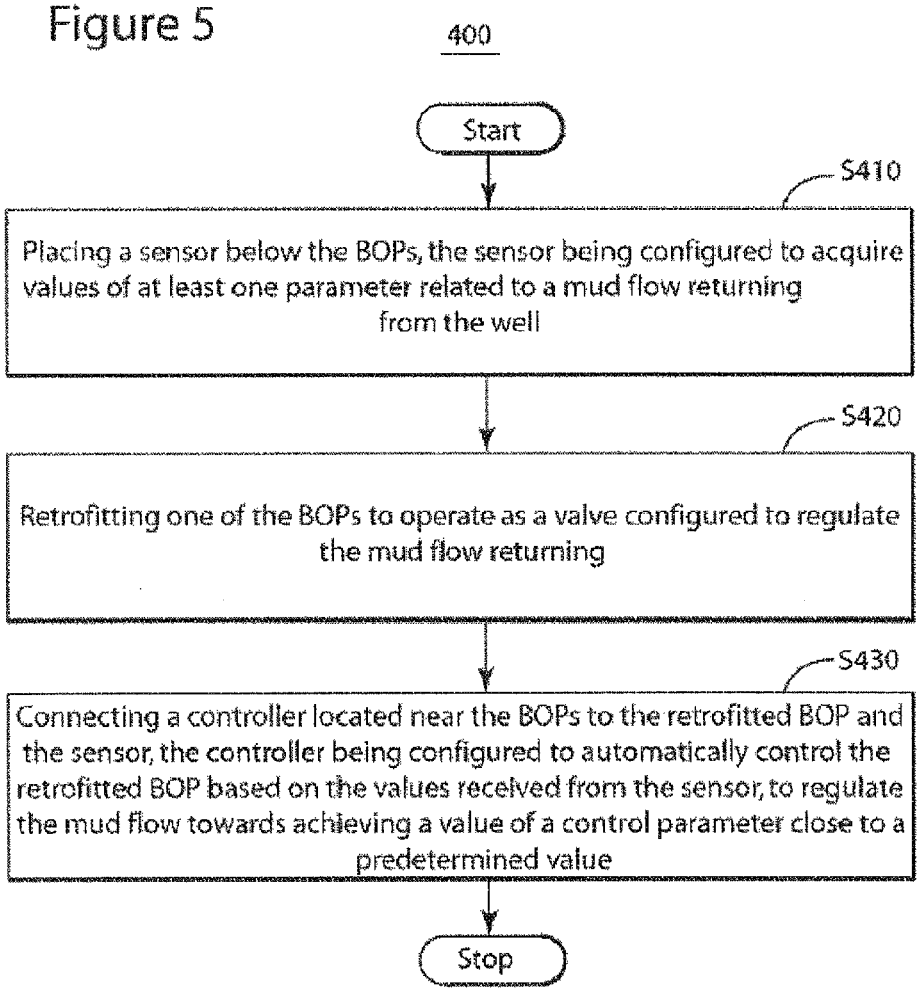
FIG. 5 is a flow diagram of a method of an offshore drilling installation according to another exemplary embodiment.

A flow diagram of a method 400 of retrofitting an offshore drilling installation having a mud loop into a well and a plurality of blowout preventers (BOPs) located close to a seabed is illustrated in FIG. 5. The method 500 includes placing a sensor below the BOP stack, a sensor below the BOPs, the sensor being configured to acquire values of at least one parameter related to a mud flow returning from the well, at S410. Further, the method 400 includes retrofitting one of the BOPs to operate as a valve configured to regulate the return mud flow, at S420. The method 400 also includes connecting a controller located near the BOPs to the retrofitted BOP and the sensor, the controller being configured to automatically control the retrofitted BOP based on the values received from the sensor, to regulate the mud flow towards achieving a value of a control parameter close to a predetermined value, at S430.

The disclosed exemplary embodiments provide apparatuses and methods for a fast local control of a return mud flow in an offshore installation. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A system for controlling flow in a subsea wellhead comprising:

a blowout preventer (BOP) on the wellhead having an axial bore that receives a drill string;

an annular space defined between the drill string and an inner surface of the BOP and through which mud exiting the wellhead selectively flows;

a sensor in the annular space for sensing a parameter of the mud;

a valve comprising a ram block in the BOP that selectively moves into and out of the annular space;

an actuator for moving the ram block; and a controller that estimates a degree of opening the valve, and that controls operation of the actuator that regulates the flow of the mud based on the values acquired by the sensor having the ram blocks moved into the annular space to reduce the flow of mud through the BOP and having the ram blocks moved out of the annular space to increase the flow of mud through the BOP.

2. The apparatus of claim 1, wherein the sensor is a pressure sensor.

3. The apparatus of claim 1, wherein the sensor is a flow meter, and wherein the controller is programmed to recognize an influx of flow to the flow of the mud, and to send a command that instructs the ram block to restrict flow through the annular space so that the influx of flow is controlled.

4. The apparatus of claim 1, wherein the controller includes a proportional-integral-derivative (PID) loop.

5. The apparatus of claim 1, wherein the control parameter is an equivalent circulating density.

6. The apparatus of claim 1, wherein the control parameter is a pressure below the valve or at a bottom of the well.

7. The apparatus of claim 1, wherein the actuator comprises: a hydraulic valve that controls hydraulic fluid to the ram block, and is connected to the controller.

8. The apparatus of claim 7, wherein the hydraulic valve may be controlled manually and receive hydraulic fluid from a remote operated vehicle.

9. A method of operating a blowout preventer (BOP) comprising:

sensing a return mud flow through the BOP with a flow meter disposed proximate the BOP;

acquiring a flow rate of the mud flow based on the step of sensing a return mud flow;

determining a designated position of rams in the BOP to achieve a parameter of the mud flow; and controlling the return mud flow through the BOP by moving the ram blocks to the designated position.

10. The method of claim 9, further comprising sensing a pressure of the mud flow with a pressure sensor.

* * * * *